US009950356B2

(12) United States Patent
Ishizuka et al.

(10) Patent No.: US 9,950,356 B2
(45) Date of Patent: Apr. 24, 2018

(54) FORMING DEVICE AND FORMING METHOD

(71) Applicant: SUMITOMO HEAVY INDUSTRIES, LTD., Tokyo (JP)

(72) Inventors: Masayuki Ishizuka, Niihama (JP); Norieda Ueno, Yokosuka (JP); Masayuki Saika, Niihama (JP); Takashi Komatsu, Oyama (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/403,577

(22) Filed: Jan. 11, 2017

(65) Prior Publication Data

US 2017/0120317 A1 May 4, 2017

Related U.S. Application Data

(63) Continuation of application No. PCT/JP2015/069226, filed on Jul. 3, 2015.

(30) Foreign Application Priority Data

Jul. 15, 2014 (JP) ..... 2014-145194

(51) Int. Cl.
*B21D 26/035* (2011.01)
*B21D 26/047* (2011.01)
(Continued)

(52) U.S. Cl.
CPC ..... *B21D 26/035* (2013.01); *B21D 26/033* (2013.01); *B21D 26/043* (2013.01); *B21D 26/047* (2013.01)

(58) Field of Classification Search
CPC .. B21D 26/035; B21D 26/047; B21D 26/033; B21D 26/043
(Continued)

(56) References Cited

U.S. PATENT DOCUMENTS 5,070,717 A * 12/1991 Boyd ..... B21D 19/00 29/421.1
7,249,481 B1 * 7/2007 Lowe ..... B21D 26/033 29/421.1
(Continued)

FOREIGN PATENT DOCUMENTS

JP 2001-259754 A 9/2001
JP 2006-061944 A 3/2006
(Continued)

OTHER PUBLICATIONS

International Search Report international application No. PCT/JP2015/069226 dated Sep. 29, 2015.
(Continued)

*Primary Examiner* — David B Jones
(74) *Attorney, Agent, or Firm* — Squire Patton Boggs (US) LLP

(57) ABSTRACT

A forming device includes a gas supply part supplying a gas into a metal pipe material held and heated between a first die and a second die paired with each other. A driving mechanism moves at least one of the first die and the second die in a direction in which the dies are combined together. A first cavity part is formed between the first die and the second die to form the pipe part. A second cavity part communicates with the first cavity part to form the flange part. A flange forming member can be allowed to advance or retreat in the second cavity part, and forms the flange part. A controller controls the gas supply of the gas supply part, the driving of the driving mechanism, and the advance or retreat of the flange forming member.

1 Claim, 10 Drawing Sheets

(51) Int. Cl.
*B21D 26/033* (2011.01)
*B21D 26/043* (2011.01)

(58) Field of Classification Search
USPC ..... 72/61
See application file for complete search history.

(56) References Cited

U.S. PATENT DOCUMENTS 8,171,769 B2 * 5/2012 Barthelemy ..... B21D 15/03
72/370.22
9,302,307 B2 * 4/2016 Bestard

FOREIGN PATENT DOCUMENTS

JP 2006-122979 A 5/2006
JP 2012000654 A 1/2012

OTHER PUBLICATIONS

International Preliminary report on Patentability international application No. PCT/JP2015/069226 dated Jan. 17, 2017.

* cited by examiner

FORMING DEVICE AND FORMING METHOD

RELATED APPLICATIONS

Priority is claimed to Japanese Patent Application No. 2014-145194, filed Jul. 15, 2014, the entire content of which is incorporated herein by reference.

BACKGROUND

Technical Field

Certain embodiments of the present invention relate to a forming device and a forming method.

Description of Related Art

Forming devices that form a metal pipe having a pipe part and a flange part by expansion with the supply of a gas into a heated metal pipe material have been known. For example, a forming device disclosed in Japanese Patent No. 4920772 is provided with a pair of upper and lower dies, a gas supply unit that supplies a gas into a metal pipe material held between the upper die and the lower die, a first cavity part (main cavity) that is formed by combining the upper die and the lower die together to form a pipe part, and a second cavity part (sub-cavity) that communicates with the first cavity part to form a flange part. In this forming device, the pipe part and the flange part can be simultaneously formed by closing the dies and expanding the metal pipe material with the supply of a gas into the metal pipe material.

SUMMARY

A forming device according to an aspect of the invention that forms a metal pipe having a pipe part and a flange part includes: a gas supply part that supplies a gas into a metal pipe material held and heated between a first die and a second die that are paired each other; a driving mechanism that moves at least one of the first die and the second die in a direction in which the dies are combined together; a first cavity part that is formed between the first die and the second die to form the pipe part, and a second cavity part that communicates with the first cavity part to form the flange part; a flange forming member that can be allowed to advance or retreat in the second cavity part and forms the flange part; and a controller that controls the gas supply of the gas supply part, the driving of the driving mechanism, and the advance or retreat of the flange forming member.

A forming method for forming a metal pipe by using the above-described forming device includes: moving at least one of the first die and the second die by the driving mechanism in a direction in which the dies are combined together to form the first cavity part and the second cavity part between the first die and the second die, and supplying a gas into the metal pipe material by the gas supply part to form the pipe part and the flange part in the first cavity part and the second cavity part, respectively; and crushing the flange part by the flange forming member.

A forming method according to an aspect of the invention for forming a metal formed material having a main body part and a flange part includes: preparing a heated metal material between a first die and a second die; moving at least one of the first die and the second die in a direction in which the dies are combined together to form a first cavity part and a second cavity part communicating with the first cavity part between the first die and the second die, and forming the main body part and the flange part in the first cavity part and the second cavity part, respectively; and crushing the flange part by a flange forming member that can be allowed to advance or retreat in the second cavity part and forms the flange part.

BRIEF DESCRIPTION OF THE DRAWINGS

FIG. 3A is a view showing a state in which a metal pipe material is held by the electrodes. FIG. 3B is a diagram showing a state in which a sealing member is brought into contact with the electrodes. FIG. 3C is a front view of the electrodes.

FIG. 4A is a diagram showing a state in which a metal pipe material is set in the die. FIG. 4B is a diagram showing a state in which the metal pipe material is held by the electrodes.

FIG. 6A is a diagram showing a state in which a metal pipe material is set in the blow forming die. FIG. 6B is a diagram showing a state in which the blow forming die is closed.

FIG. 7A is a diagram showing a state at the time of blow forming. FIG. 7B is a diagram showing a state in which a flange part is made thin by the pressing of a piston.

FIG. 8A is a diagram showing a state in which a metal pipe material is set in the blow forming die. FIG. 8B is a diagram showing a state in which blow forming is performed while the blow forming die is closed.

FIG. 9A is a diagram showing a state in which the blow forming die is closed. FIG. 9B is a diagram showing a state in which a flange part is made thin by the pressing of a piston.

DETAILED DESCRIPTION

Figure 1:
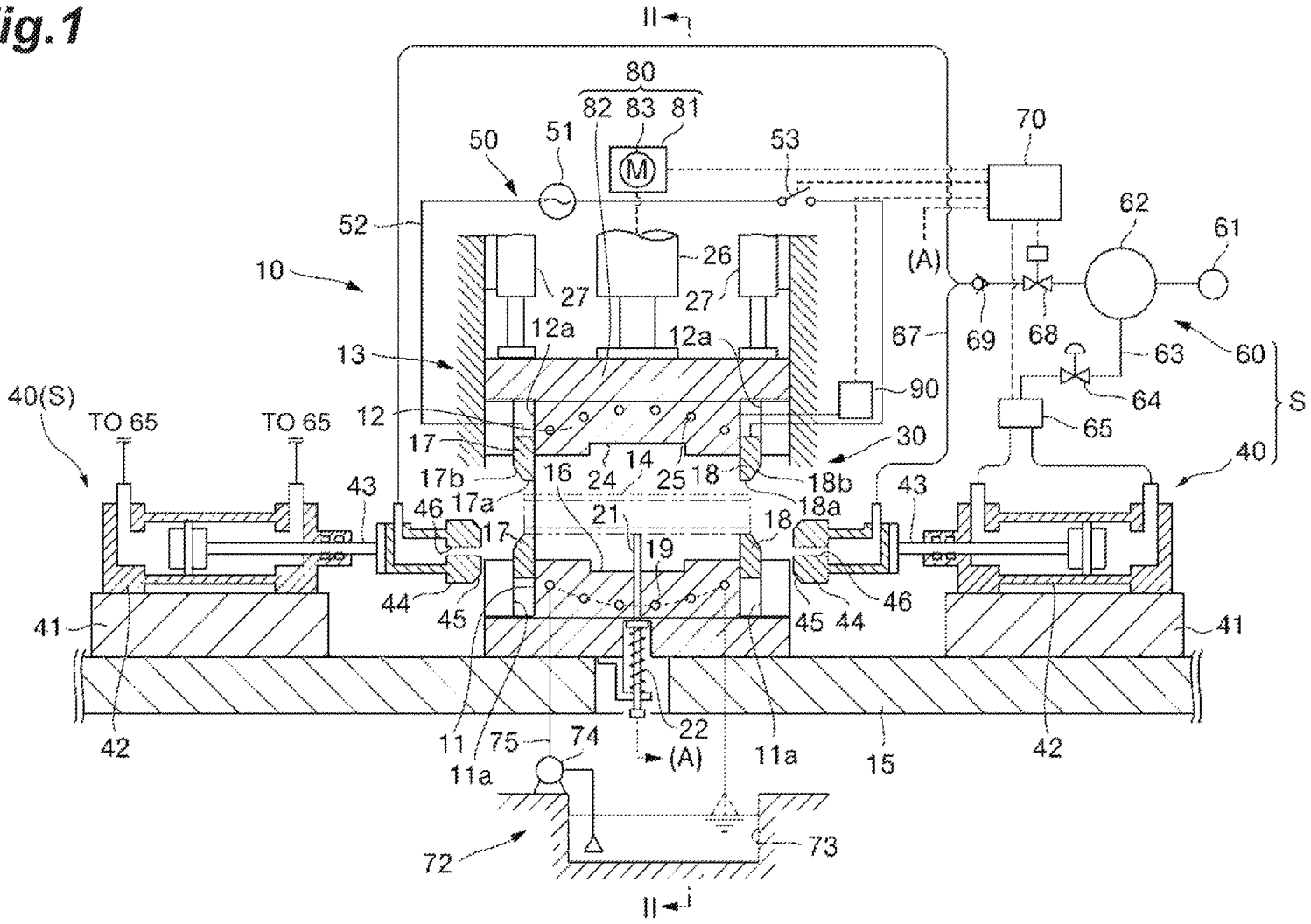
FIG. 1 is a schematic diagram of a configuration of a forming device.

Here, since the flange part formed by the forming device is formed in such a way that a part of the metal pipe material expanded and advancing in the second cavity part is folded and crushed between the upper die and the lower die, the flange part has a larger thickness than the pipe part. Therefore, there is a problem in that the flange part is not easily welded to another component depending on the thickness and the quenching degree of the metal pipe material. For example, in spot welding, the larger the thicknesses of the flange part and another component to be subjected to welding, the more the current is required to flow, and thus there is a problem in that a welding error occurs depending on the thickness of the flange part.

As a measure for the problem related to the welding, reducing the thickness of the flange part by reducing the thickness of the metal pipe material is exemplified. However, in this case, the thickness of the pipe part is reduced, and thus there is a problem in that the strength of the metal pipe is reduced.

It is desirable to provide a forming device and a forming method capable of suppressing a reduction in strength of a formed material and of forming a flange part having a desired thickness.

According to such a forming device, by controlling the driving mechanism by the controller, at least one of the first die and the second die that are paired each other is moved in a direction in which the dies are combined together to form the first cavity part and the second cavity part communicating with the first cavity part. In addition, by controlling the gas supply part by the controller, a gas is supplied from the gas supply part into the metal pipe material held and heated between the first die and the second die to form the pipe part of a metal pipe and a flange part of the metal pipe in the first cavity part and the second cavity part, respectively. Furthermore, by controlling the flange forming member by the controller, the flange forming member can be allowed to advance in the second cavity part, and the formed flange part can be crushed. Accordingly, the thickness of the flange part can be adjusted to be small even though the metal pipe material is not made thin. Thus, according to the forming device, it is possible to suppress a reduction in strength of the metal pipe that is a formed material, and to form the flange part having a desired thickness.

Here, the flange forming member is preferably provided in at least one of the first die and the second die. For example, in a case where the shape of a metal pipe to be formed is changed, it is necessary to replace the dies. However, in this case, the flange forming member provided in the die can also be replaced together. Therefore, the time required for replacing the dies and the flange forming member can be reduced.

According to such a forming method, the driving mechanism moves at least one of the first die and the second die in a direction in which the dies are combined together, and thus the first cavity part and the second cavity part are formed between the first die and the second die. In addition, the gas supply part supplies a gas into the metal pipe material to form the pipe part of the metal pipe and the flange part of the metal pipe in the first cavity part and the second cavity part, respectively. Furthermore, by crushing the flange part formed in the second cavity part by the flange forming member, the thickness of the flange part can be adjusted to be small. Thus, according to the above-described forming method, it is possible to suppress a reduction in strength of the metal pipe that is a formed material, and to form the flange part having a desired thickness.

The flange part is preferably crushed such that a thickness of the flange part is smaller than a thickness of the pipe part. By making the flange part thinner than the pipe part as described above, welding between the flange part and another component can be excellently performed.

The gas supply part preferably supplies a gas into the pipe part when the flange part is crushed by the flange forming member. In this case, it is possible to suppress intrusion of a part of the crushed flange part to the first cavity part. Accordingly, a metal pipe having a desired shape can be provided.

The pressing of the flange part by the flange forming member is preferably started in parallel with the forming of the pipe part. In this case, the time period for forming a metal pipe having a flange part having a desired thickness can be reduced.

According to such a forming method, by moving at least one of the first die and the second die in a direction in which the dies are combined together, the first cavity part and the second cavity part communicating with the first cavity part are formed between the first die and the second die. In this case, by preparing a heated metal material between the first die and the second die, the main body part of the metal formed material can be formed in the first cavity part, and the flange part of the metal formed material can be formed in the second cavity part. Furthermore, by crushing the flange part by the flange forming member that can be allowed to advance or retreat in the second cavity part, the thickness of the flange part can be adjusted to be small. Thus, according to the above-described forming method, it is possible to suppress a reduction in strength of the metal formed material, and to form the flange part having a desired thickness.

Hereinafter, preferable embodiments of a forming device and a forming method according to an aspect of the invention will be described with reference to the drawings. In the drawings, the same or similar parts will be denoted by the same reference signs, and overlapping description will be omitted.

Configuration of Forming Device

FIG. 1 is a schematic diagram of a configuration of a forming device. As shown in FIG. 1, a forming device 10 that forms a metal pipe 100 (see FIG. 5) is provided with a blow forming die 13 that includes an upper die (first die) 12 and a lower die (second die) 11, a driving mechanism 80 that moves at least one of the upper die 12 and the lower die 11, a pipe holding mechanism (holding unit) 30 that holds a metal pipe material 14 between the upper die 12 and the lower die 11, a heating mechanism (heater) 50 that energizes the metal pipe material 14 held by the pipe holding mechanism 30 to heat the metal pipe material, a gas supply part S that supplies a high-pressure gas (gas) into the metal pipe material 14 held and heated between the upper die 12 and the lower die 11, an oil supply pump 90 that supplies an oil to a cylinder 93 (see FIG. 2) in the upper die 12, a water circulation mechanism 72 that forcibly cools the blow forming die 13 with water, and a controller 70 that controls operations of the driving mechanism 80, the pipe holding mechanism 30, the heating mechanism 50, the gas supply part S, and the oil supply pump 90. The gas supply part S is provided with a pair of gas supply mechanisms 40 that supply a gas into the metal pipe material 14 held by the pipe holding mechanism 30, and a blow mechanism 60 that supplies a gas to the pair of gas supply mechanisms 40.

The lower die (second die) 11 is fixed to a large base 15. The lower die 11 is composed of a large steel block and is provided with a cavity (recessed part) 16 in an upper surface thereof. An electrode storage space 11*a* is provided near each of right and left ends (right and left ends in FIG. 1) of the lower die 11. The forming device 10 is provided with a first electrode 17 and a second electrode 18 that are configured to advance or retreat in a vertical direction by an actuator (not shown) in the electrode storage space 11*a*. Recessed grooves 17*a* and 18*a* having a semi-arc shape corresponding to an outer peripheral surface on the lower side of the metal pipe material 14 are formed in upper surfaces of the first electrode 17 and the second electrode 18, respectively (see FIG. 3C), and the metal pipe material 14 can be placed to be well fitted in the recessed grooves 17*a* and 18*a*. In addition, in a front surface of the first electrode 17 (a surface of the die in an outward direction), a tapered recessed surface 17*b* is formed such that the vicinity thereof is recessed at an angle into a tapered shape toward the recessed groove 17*a*, and in a front surface of the second electrode 18 (a surface of the die in an outward direction), a tapered recessed surface 18*b* is formed such that the vicinity thereof is recessed at an angle into a tapered shape toward the recessed groove 18*a*. In addition, a cooling water passage 19 is formed in the lower die 11 and is provided with a thermocouple 21 inserted from the bottom at a substantially center thereof. This thermocouple 21 is supported movably up and down by a spring 22.

The pair of first and second electrodes 17 and 18 positioned in the lower die 11 constitute the pipe holding mechanism 30, and can elevatably support the metal pipe material 14 between the upper die 12 and the lower die 11. The thermocouple 21 is just an example of the temperature measuring unit, and a non-contact temperature sensor such as a radiation thermometer or an optical thermometer may be provided. A configuration without the temperature measuring unit may also be employed if the correlation between the energization time and the temperature can be obtained.

The upper die (first die) 12 is a large steel block that is provided with a cavity (recessed part) 24 in a lower surface thereof and a cooling water passage 25 built therein. An upper end part of the upper die 12 is fixed to a slide 82. The slide 82 to which the upper die 12 is fixed is suspended by a pressing cylinder 26, and is guided by a guide cylinder 27 so as not to laterally vibrate.

Similarly to the case of the lower die 11, an electrode storage space 12*a* is provided near each of right and left ends (right and left ends in FIG. 1) of the upper die 12. The forming device 10 is provided with a first electrode 17 and a second electrode 18 that are configured to advance or retreat in a vertical direction by an actuator (not shown) in the electrode storage space 12*a* as in the lower die 11. Recessed grooves 17*a* and 18*a* having a semi-arc shape corresponding to an outer peripheral surface on the upper side of the metal pipe material 14 are formed in lower surfaces of the first electrode 17 and the second electrode 18, respectively (see FIG. 3C), and the metal pipe material 14 can be well fitted in the recessed grooves 17*a* and 18*a*. In addition, in a front surface of the first electrode 17 (a surface of the die in an outward direction), a tapered recessed surface 17*b* is formed such that the vicinity thereof is recessed at an angle into a tapered shape toward the recessed groove 17*a*, and in a front surface of the second electrode 18 (a surface of the die in an outward direction), a tapered recessed surface 18*b* is formed such that the vicinity thereof is recessed at an angle into a tapered shape toward the recessed groove 18*a*. Accordingly, in a case where the pair of first and second electrodes 17 and 18 positioned in the upper die 12 also constitute the pipe holding mechanism 30 and the metal pipe material 14 is sandwiched between the pairs of upper and lower first and second electrodes 17 and 18 in the vertical direction, the metal pipe material 14 can be surrounded such that the outer periphery thereof firmly adheres well over the whole periphery.

The driving mechanism 80 is provided with the slide 82 that moves the upper die 12 so as to combine the upper die 12 and the lower die 11 together, a driving unit 81 that generates a driving force for moving the slide 82, and a servo motor 83 that controls a fluid amount with respect to the driving unit 81. The driving unit 81 is composed of a fluid supply unit that supplies a fluid (an operating oil in a case where a hydraulic cylinder is employed as the pressing cylinder 26) for driving the pressing cylinder 26 to the pressing cylinder 26.

The controller 70 can control the movement of the slide 82 by controlling the amount of the fluid to be supplied to the pressing cylinder 26 by controlling the servo motor 83 of the driving unit 81. The driving unit 81 is not limited to a unit that applies a driving force to the slide 82 via the pressing cylinder 26 as described above. For example, the driving unit 81 may directly or indirectly apply a driving force generated by the servo motor 83 to the slide 82 by mechanically connecting the driving mechanism to the slide 82. For example, a driving mechanism having an eccentric shaft, a driving source (for example, a servo motor and a reducer) that applies a rotating force for rotating the eccentric shaft, and a converter (for example, a connecting rod or an eccentric sleeve) that converts the rotational movement of the eccentric shaft into the linear movement to move the slide may be employed. In this embodiment, the driving unit 81 may not have the servo motor 83.

Figure 2:
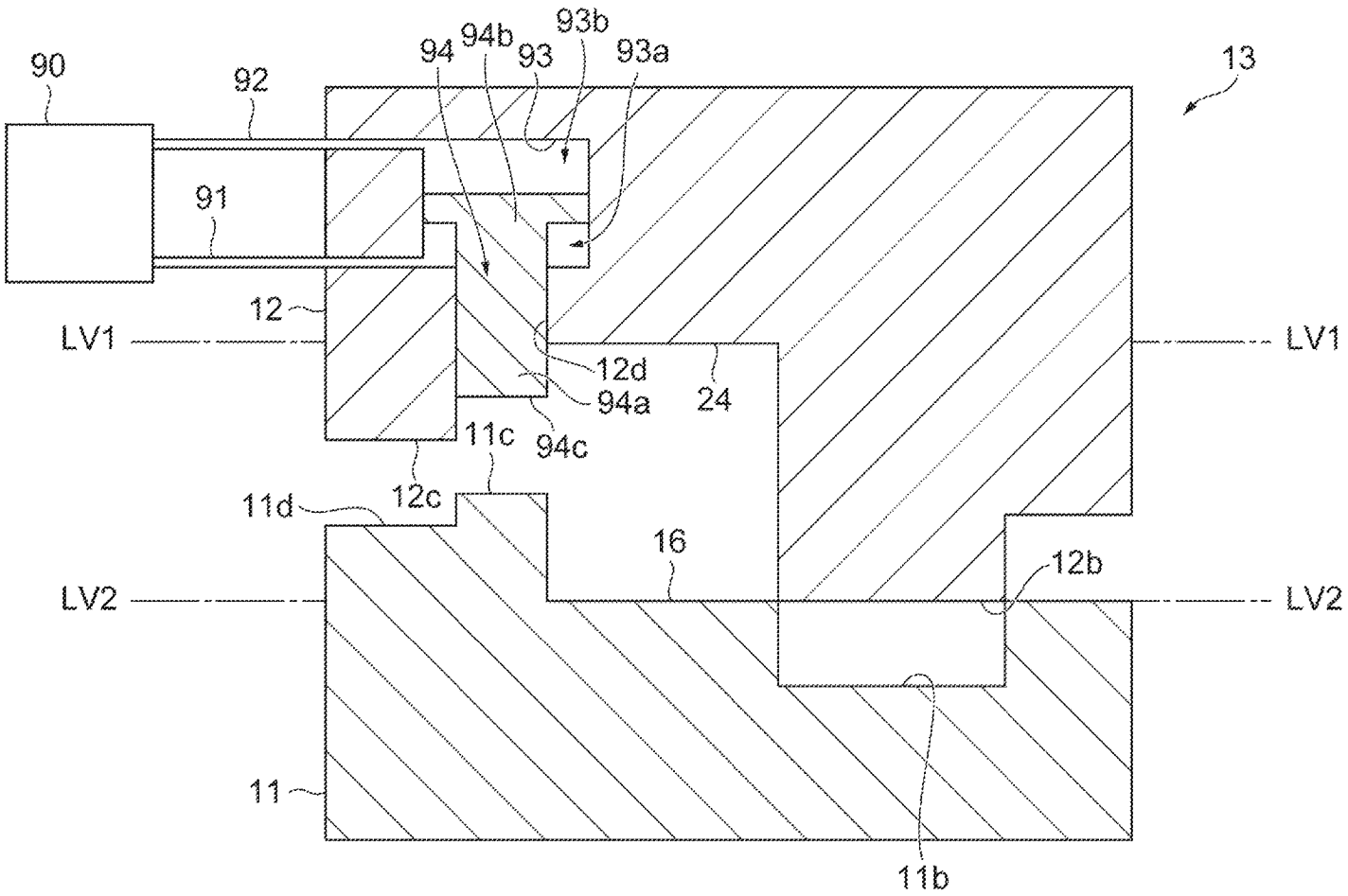
FIG. 2 is a diagram in which, to a cross-sectional view of a blow forming die taken along line II-II shown in FIG. 1, an oil supply pump that is connected to the blow forming die is added.

FIG. 2 is a diagram in which, to a cross-sectional view of the blow forming die 13 taken along line II-II shown in FIG. 1, the oil supply pump 90 that is connected to the blow forming die 13 is added. As shown in FIG. 2, steps are provided in all of the upper surface of the lower die 11 and the lower surface of the upper die 12.

The upper surface of the lower die 11 has steps formed by a first recessed part 11*b*, a first protrusion 11*c*, and a second protrusion 11*d* in a case where a surface of the cavity 16 of the lower die 11 is a reference line LV2. The first recessed part 11*b* is formed on the right side (on the right side in FIG. 2) of the cavity 16, and the first protrusion 11*c* and the second protrusion 11*d* are formed on the left side (on the left side in FIG. 2) of the cavity 16. The first protrusion 11*c* is positioned between the cavity 16 and the second protrusion 11*d*. The first protrusion 11*c* protrudes closer to the upper die 12 than the second protrusion 11*d*.

The lower surface of the upper die 12 has steps formed by a first protrusion 12*b* and a second protrusion 12*c* in a case where a surface of the cavity 24 of the upper die 12 is a reference line LV1. The most protruding first protrusion 12*b* is formed on the right side (on the right side in FIG. 2) of the cavity 24, and the second protrusion 12*c* is formed on the left side (on the left side in FIG. 2) of the cavity 24. An opening part 12*d* is provided between the cavity 24 and the second protrusion 12*c*. A piston 94 (to be described below in detail) that can be allowed to advance or retreat in a direction in which the lower die 11 and the upper die 12 are opposed to each other, and that is a flange forming member forming a flange part 100*c* (see FIG. 7B) of a metal pipe 100 to be described below is inserted in the opening part 12*d*.

Here, the upper die 12 has the cylinder 93 that is provided therein and filled with an operating oil, and the piston 94 that is slidable inside the cylinder 93. By a base end part 94*b* provided at one end (an upper end in FIG. 2) of the piston 94, the inside of the cylinder 93 is divided into a lower region 93*a* and an upper region 93*b*. A tip end surface 94*c* of a main body part 94*a* positioned lower than the base end part 94*b* of the piston 94 is exposed and protrudes from the upper die 12 to the lower side, and is opposed to the first protrusion 11*c* of the lower die 11. The cylinder 93 is connected to the above-described oil supply pump 90 via a pipe 91 connected to the lower region 93*a* and a pipe 92 connected to the upper region 93*b*.

The controller 70 can control the amount of the fluid to be supplied to the lower region 93*a* and the upper region 93*b* of the cylinder 93, and control the movement of the piston 94 by controlling the oil supply pump 90. For example, by controlling the oil supply pump 90 by the controller 70, the operating oil can be supplied into the upper region 93*b* and the operating oil filled inside the lower region 93*a* can be discharged. In addition, the piston 94 can be allowed to advance toward the lower die 11.

In addition, the first protrusion 12*b* of the upper die 12 can be well fitted in the first recessed part 11*b* of the lower die 11. The second protrusion 12*c* of the upper die 12 and the second protrusion 11*d* of the lower die 11 are brought into contact with each other when the upper die 12 and the lower die 11 are fitted together. A space is formed between the tip end surface 94*c* of the piston 94 attached to the upper die 12 and the first protrusion 11*c* of the lower die 11 when the upper die 12 and the lower die 11 are fitted together. In addition, a space is formed between the cavity 24 of the upper die 12 and the cavity 16 of the lower die 11 when the upper die 12 and the lower die 11 are fitted together.

Figure 6A:
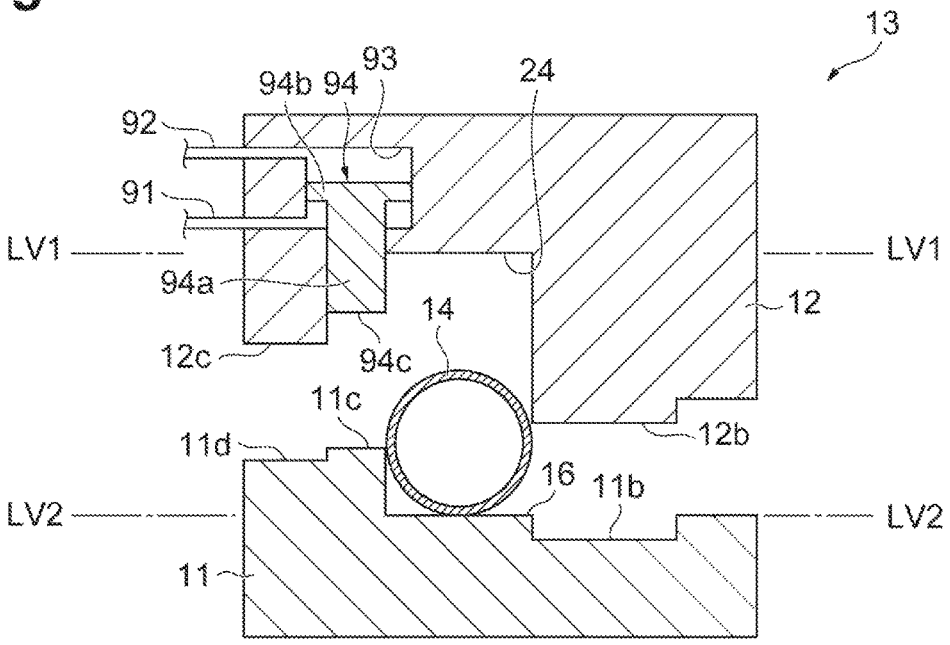
FIGS. 6A and 6B are diagrams showing an operation of the blow forming die and a change of the shape of the metal pipe material.
Figure 6B:
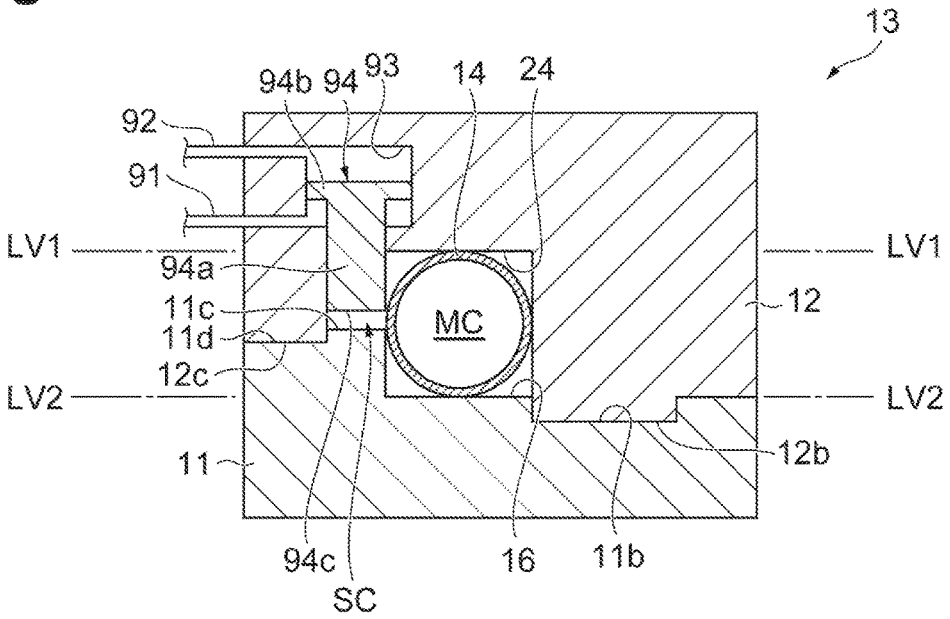

That is, as shown in FIG. 6B, by fitting the lower die 11 and the upper die 12 together at the time of blow forming, a main cavity part (first cavity part) MC is formed between the surface (the surface as the reference line LV1) of the cavity 24 of the upper die 12 and the surface (the surface as the reference line LV2) of the cavity 16 of the lower die 11. A sub-cavity part (second cavity part) SC that communicates with the main cavity part MC and has a smaller volume than the main cavity part MC is formed between the tip end surface 94*c* of the piston 94 and the first protrusion 11*c* of the lower die 11. The main cavity part MC is a part that forms a pipe part 100*a* of a metal pipe 100, and the sub-cavity part SC is a part that forms flange parts 100*b* and 100*c* of the metal pipe 100 (see FIGS. 7A and 7B). In a case where the lower die 11 and the upper die 12 are combined together and completely closed, the main cavity part MC and the sub-cavity part SC are sealed in the lower die 11 and the upper die 12.

As shown in FIG. 1, the heating mechanism 50 has a power supply 51, conductive wires 52 that extend from the power supply 51 and are connected to the first electrodes 17 and the second electrodes 18, and a switch 53 that is provided on the conductive wire 52. The controller 70 can heat the metal pipe material 14 to a quenching temperature (equal to or higher than a AC3 transformation temperature) by controlling the heating mechanism 50.

Figure 3A:
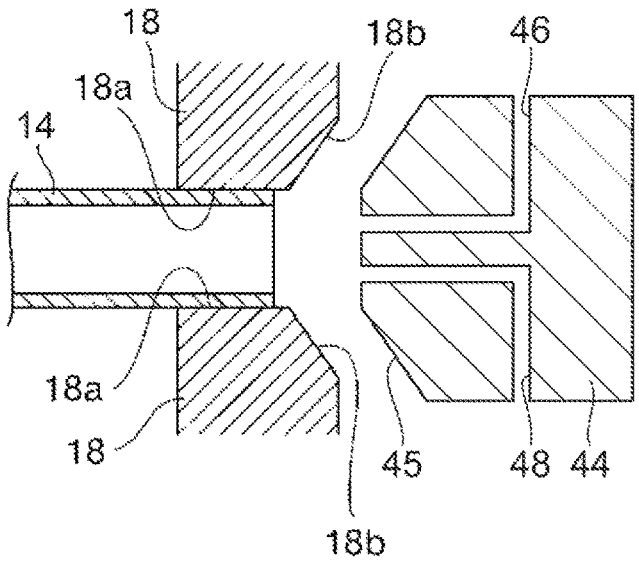
FIGS. 3A to 3C are enlarged views of the vicinity of electrodes.
Figure 3B:
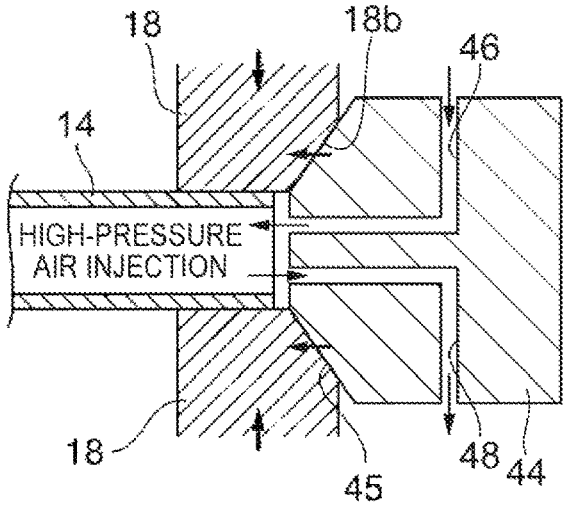
Figure 3C:
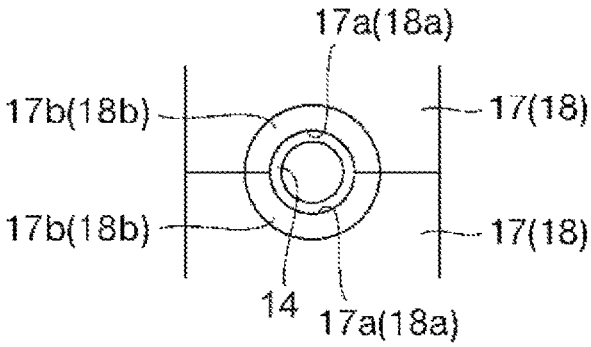

Each of the pair of gas supply mechanisms 40 of the gas supply part S has a cylinder unit 42, a cylinder rod 43 that advances or retreats in accordance with the operation of the cylinder unit 42, and a sealing member 44 that is connected to a tip end of the cylinder rod 43 on the side of the pipe holding mechanism 30. The cylinder unit 42 is placed and fixed on the base 15 via a block 41. A tapered surface 45 is formed at a tip end of each sealing member 44 so as to be tapered. One tapered surface 45 is formed into such a shape as to be well fitted in and brought into contact with the tapered recessed surface 17*b* of the first electrode 17, and the other tapered surface 45 is formed into such a shape as to be well fitted in and brought into contact with the tapered recessed surface 18*b* of the second electrode 18 (see FIGS. 3A to 3C). The sealing member 44 extends from the cylinder unit 42 to the top end. Specifically, as shown in FIGS. 3A and 3B, a gas passage 46 and an exhaust passage 48 through which a high-pressure gas supplied from the blow mechanism 60 flows are provided. That is, the pair of gas supply mechanisms 40 are connected to the blow mechanism 60.

The blow mechanism 60 of the gas supply part S includes a high-pressure gas supply 61, an accumulator 62 that stores a high-pressure gas supplied by the high-pressure gas supply 61, a first tube 63 that extends from the accumulator 62 to the cylinder unit 42 of the gas supply mechanism 40, a pressure control valve 64 and a switching valve 65 that are provided in the first tube 63, a second tube 67 that extends from the accumulator 62 to the gas passage 46 formed in the sealing member 44, and an on/off valve 68 and a check valve 69 that are provided in the second tube 67. The pressure control valve 64 functions to supply, to the cylinder unit 42, a high-pressure gas at an operation pressure adapted for the pressing force required from the sealing member 44. The check valve 69 functions to prevent the high-pressure gas from flowing backward in the second tube 67.

The controller 70 can supply a high-pressure gas that is a gas into the metal pipe material 14 by controlling the pair of gas supply mechanisms 40 and the blow mechanism 60 of the gas supply part S.

The controller 70 acquires temperature information from the thermocouple 21 by information transmission from (A), and controls the pressing cylinder 26 and the switch 53. The water circulation mechanism 72 includes a water tank 73 that stores water, a water pump 74 that draws up and pressurizes the water stored in the water tank 73 to send the water to the cooling water passage 19 of the lower die 11 and the cooling water passage 25 of the upper die 12, and a pipe 75. Although omitted, a cooling tower that lowers the water temperature or a filter that purifies the water may be provided in the pipe 75.

Action of Forming Device

Figure 4A:
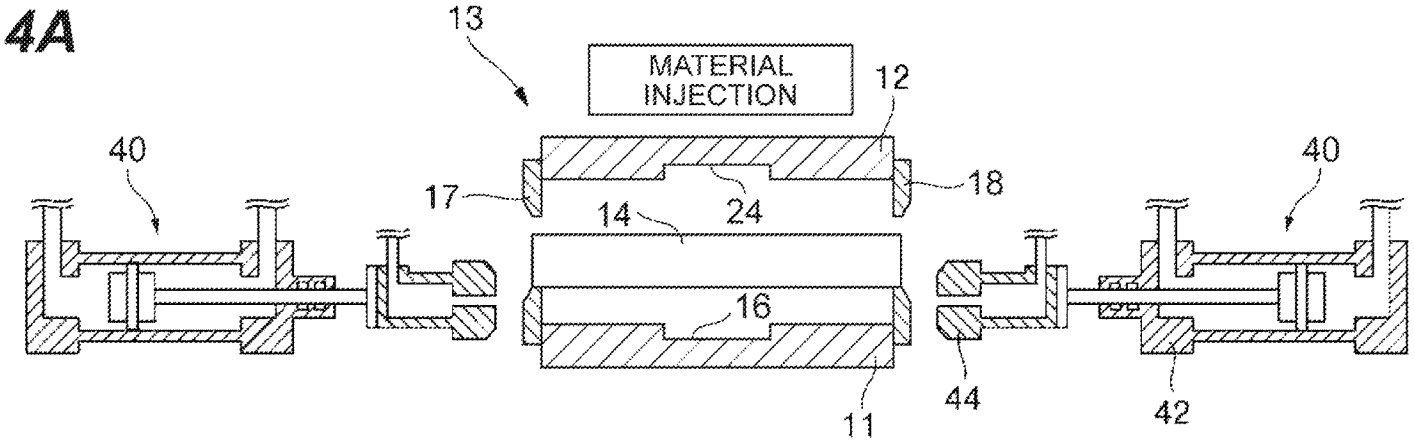
FIGS. 4A and 4B are diagrams showing a manufacturing process using the forming device.
Figure 4B:
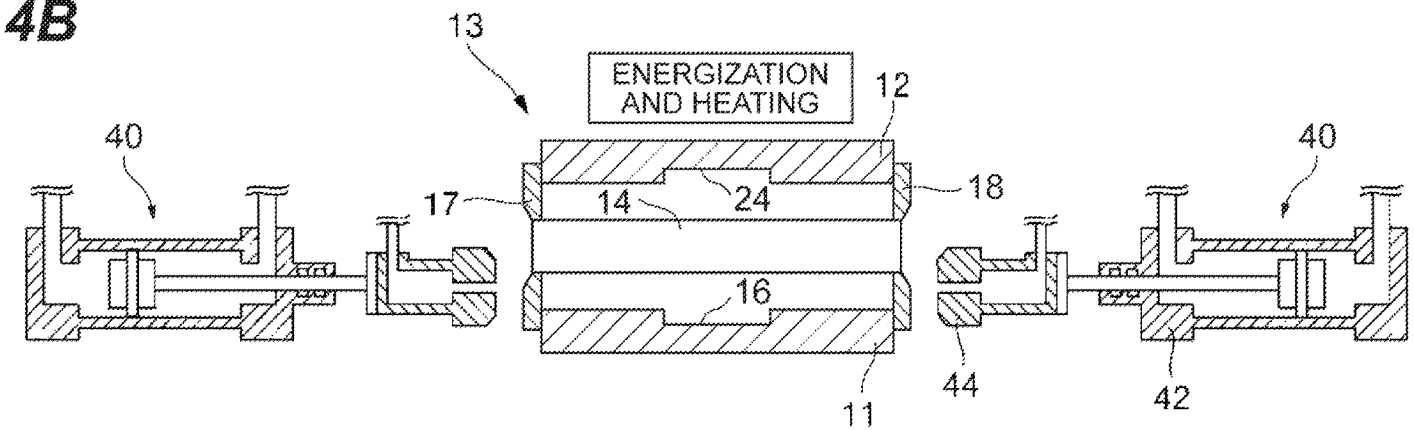

Next, the action of the forming device 10 will be described. FIGS. 4A and 4B show steps from a pipe injection step for injecting the metal pipe material 14 as a material to an energization and heating step for heating the metal pipe material 14 by energization. First, a metal pipe material 14 that is a quenchable steel type is prepared. As shown in FIG. 4A, the metal pipe material 14 is placed (injected) on the first and second electrodes 17 and 18 provided in the lower die 11 using, for example, a robot arm or the like. Since the first and second electrodes 17 and 18 have the recessed grooves 17*a* and 18*a*, respectively, the metal pipe material 14 is positioned by the recessed grooves 17*a* and 18*a*. Next, the controller 70 (see FIG. 1) controls the pipe holding mechanism 30 to hold the metal pipe material 14 by the pipe holding mechanism 30. Specifically, as in FIG. 4B, an actuator that allows the first and second electrodes 17 and 18 to advance or retreat is operated such that the first and second electrodes 17 and 18 positioned on the upper and lower sides, respectively, are brought closer to and into contact with each other. Due to this contact, both of the end parts of the metal pipe material 14 are sandwiched between the first and second electrodes 17 and 18 from the upper and lower sides. In addition, due to the presence of the recessed grooves 17*a* and 18*a* formed in the first and second electrodes 17 and 18, the metal pipe material 14 is sandwiched so as to firmly adhere over the whole periphery thereof. However, the invention is not limited to the configuration in which the metal pipe material 14 firmly adheres over the whole periphery thereof, and may have a configuration in which the first and second electrodes 17 and 18 are brought into contact with a part of the metal pipe material 14 in a peripheral direction.

Next, as shown in FIG. 1, the controller 70 controls the heating mechanism 50 to heat the metal pipe material 14. Specifically, the controller 70 turns on the switch 53 of the heating mechanism 50. After that, electric power is supplied from the power supply 51 to the metal pipe material 14, and the metal pipe material 14 produces heat (Joule heat) due to the resistance present in the metal pipe material 14. In this case, the measurement value of the thermocouple 21 is monitored always, and based on the results thereof, the energization is controlled.

Figure 5:
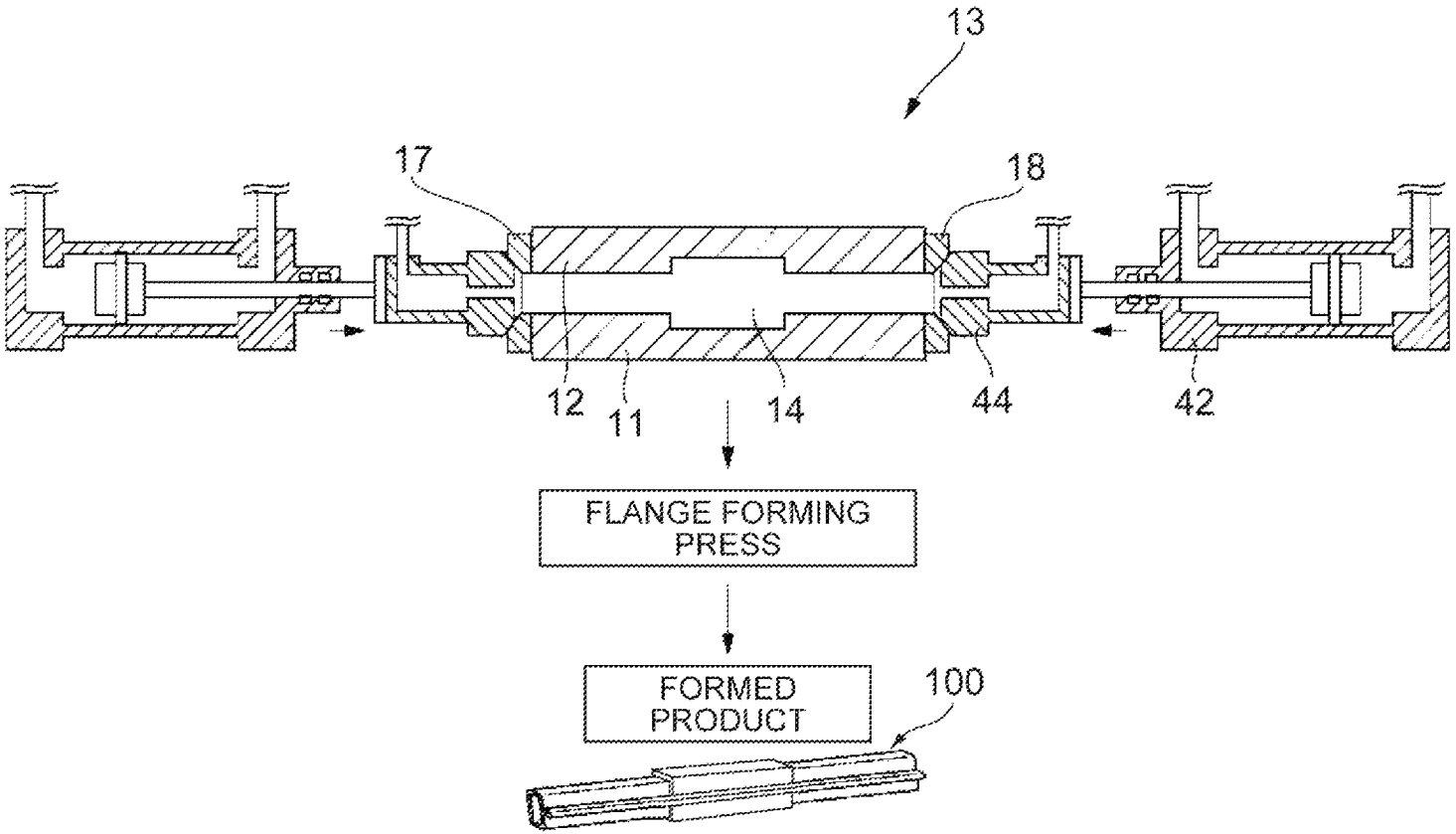
FIG. 5 is a diagram showing a blow forming step using the forming device and a flow thereafter.

FIG. 5 shows a blow forming step using the forming device and a flow thereafter. As shown in FIG. 5, the blow forming die 13 is closed with respect to the metal pipe material 14 after heating to dispose and seal the metal pipe material 14 in the cavity of the blow forming die 13. Then, the cylinder unit 42 of the gas supply mechanism 40 is operated to seal both ends of the metal pipe material 14 by the sealing member 44 (see FIGS. 3A to 3C as well). After completion of the sealing, a high-pressure gas is allowed to flow into the metal pipe material 14 to deform the metal pipe material 14 softened by heating along the shape of the cavity.

The metal pipe material 14 is softened by being heated at a high temperature (about 950° C.), and can be subjected to blow forming at a relatively low pressure. Specifically, in a case where compressed air at a room temperature (25° C.) is employed at 4 MPa as the high-pressure gas, this compressed air is heated to about 950° C. in the sealed metal pipe material 14 as a result. The compressed air is thermally expanded and reaches approximately 16 to 17 MPa based on the Boyle Charle's law. That is, the metal pipe material 14 at 950° C. is easily expanded by the thermally expanded compressed air, and thus a metal pipe 100 can be obtained.

Quenching is performed in such a way that the outer peripheral surface of the metal pipe material 14 expanded by being subjected to the blow forming is brought into contact with the cavity 16 of the lower die 11 so as to be rapidly cooled, and simultaneously, brought into contact with the cavity 24 of the upper die 12 so as to be rapidly cooled (since the upper die 12 and the lower die 11 have a large heat capacity and are managed at a low temperature, the heat of the pipe surface is taken to the dies at once in a case where the metal pipe material 14 are brought into contact with the dies.). Such a cooling method is referred to as die contact cooling or die cooling. Immediately after the rapid cooling, the austenite is transformed to martensite. Since the cooling rate is low in the second half of the cooling, the martensite is transformed to another structure (troostite, sorbate, or the like). Therefore, there is no need to perform a separate tempering treatment. In this embodiment, in place of or in addition to the die cooling, a cooling medium is supplied to the metal pipe 100 to perform cooling.

Next, an example of specific forming using the upper die 12 and the lower die 11 will be described in detail with reference to FIGS. 6A, 6B, 7A, and 7B. As shown in FIG. 6A, the metal pipe material 14 is held on the cavity 16 between the upper die 12 and the lower die 11. By moving the upper die 12 by the driving mechanism 80, the upper die 12 and the lower die 11 are combined together and completely closed (clamped) as shown in FIG. 6B. Accordingly, the main cavity part MC is formed between the surface of the cavity 24 at the reference line LV1 and the surface of the cavity 16 at the reference line LV2. In addition, the sub-cavity part SC is formed between the tip end surface 94*c* of the piston 94 provided in the upper die 12 and the first protrusion 11*c* of the lower die 11. The main cavity part MC and the sub-cavity part SC communicate with each other. The main cavity part MC and the sub-cavity part SC are sealed by the upper die 12 and the lower die 11.

Figure 7A:
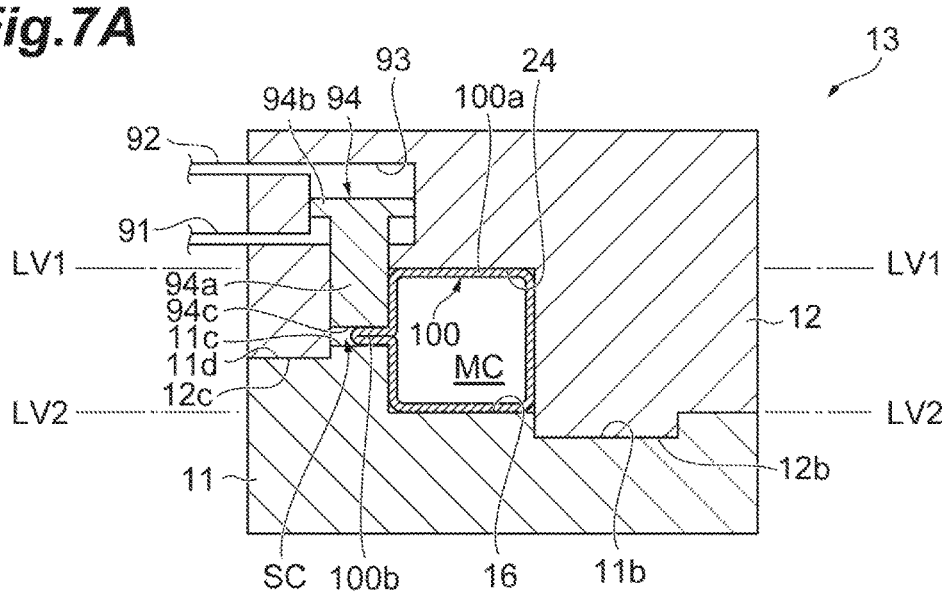
FIGS. 7A and 7B are diagrams showing an operation of the blow forming die and a change of the shape of the metal pipe material, following FIGS. 6A and 6B.

The metal pipe material 14 that is softened by being heated by the heating mechanism 50 and to which the high-pressure gas is injected by the gas supply part S is expanded in the main cavity part MC as shown in FIG. 7A. In addition, it enters into the sub-cavity SC communicating with the main cavity part MC and is expanded. Accordingly, a pipe part 100*a* of the metal pipe 100 is formed in the main cavity part MC, and a flange part 100*b* of the metal pipe 100 is formed in the sub-cavity part SC. The flange part 100*b* is formed in such a way that a part of the metal pipe material 14 is folded along the longitudinal direction of the metal pipe 100.

In the example shown in FIG. 7A, the main cavity part MC is configured to have a rectangular cross-sectional shape. Accordingly, by subjecting the metal pipe material 14 to blow forming in accordance with the shape, the pipe part 100*a* is formed into a rectangular tube shape. However, the shape of the main cavity part MC is not particularly limited, and all shapes such as an annular cross-sectional shape, an elliptical cross-sectional shape, and a polygonal cross-sectional shape may be employed in accordance with a desired shape. By previously adjusting the distance between the tip end surface 94*c* of the piston 94 constituting the sub-cavity part SC and the first protrusion 11*c* of the lower die 11 in the vertical direction, the flange part 100*b* is formed in such a state that there is no space in its folded part.

Figure 7B:
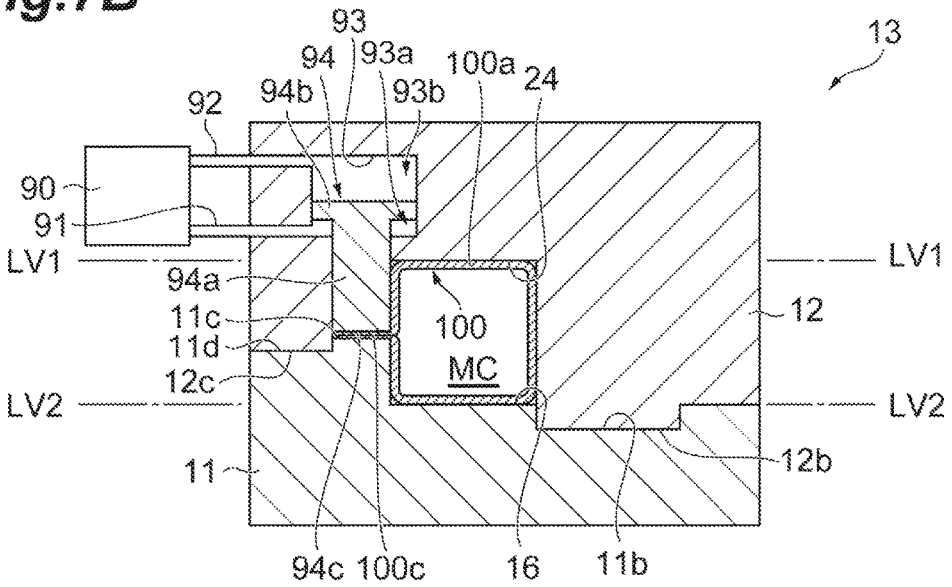

Next, as shown in FIG. 7B, the oil supply pump 90 that is controlled by the controller 70 supplies an operating oil to the upper region 93*b* via the pipe 92 and discharges an operating oil from the lower region 93*a* via the pipe 91 to allow the piston 94 to advance in the sub-cavity SC. In this manner, by the controller 70 and the oil supply pump 90, the piston 94 is allowed to advance in the sub-cavity SC to crush the flange part 100*b*, and the thinned flange part 100*c* is formed. The thickness of this flange part 100*c* is smaller than the thickness of the pipe part 100*a*.

When the flange part 100*b* is crushed by the piston 94, the gas supply part S continues the supply of the gas into the pipe part 100*a*. Accordingly, it is possible to suppress intrusion of a part of the crushed flange part 100*c* to the main cavity part MC, and to complete the metal pipe 100 having no slack and torsion. The time period from the blow forming of the metal pipe material 14 to the completion of the forming of the metal pipe 100 is about several seconds, although depending on the type of the metal pipe material 14.

According to such a forming device 10, the upper die 12 of the blow forming die 13 to be paired is moved by controlling the driving mechanism 80 by the controller 70 in a direction in which the upper die 12 and the lower die 11 are combined together, and the main cavity part MC and the sub-cavity part SC communicating with the main cavity part MC are formed. By controlling the gas supply part S by the controller 70, a gas is supplied from the gas supply part S into the metal pipe material 14 held and heated between the upper die 12 and the lower die 11, and thus the pipe part 100*a* of the metal pipe 100 can be formed in the main cavity part MC, and the flange part 100*b* of the metal pipe 100 can be formed in the sub-cavity part SC. Moreover, by controlling the piston 94 that is a flange forming member by the controller 70, the piston 94 can be allowed to advance in the sub-cavity part SC, and can crush the formed flange part 100*b*. Accordingly, the flange part 100*c* adjusted to be made thin can be formed even though the metal pipe material 14 is not made thin. Thus, according to the forming device 10, it is possible to suppress a reduction in strength of the metal pipe 100 that is a formed material, and to form the flange part 100*c* having a desired thickness.

The piston 94 is provided in the upper die 12. Therefore, in a case where the upper die 12 and the lower die 11 are replaced to change the shape of a metal pipe 100 to be formed, the piston 94 provided in the upper die 12 can also be replaced together. Therefore, the time required for replacing the upper die 12, the lower die 11, and the piston 94 can be reduced.

According to the method for forming the metal pipe 100 using the above-described forming device 10, the driving mechanism 80 moves the upper die 12 in a direction in which the blow forming die 13 is combined, and thus the main cavity part MC and the sub-cavity part SC are formed between the upper die 12 and the lower die 11. In addition, the gas supply part S supplies a gas into the metal pipe material 14 to form the pipe part 100*a* of the metal pipe 100 and the flange part 100*b* of the metal pipe 100 in the main cavity part MC and the sub-cavity part SC, respectively. Furthermore, by crushing the flange part 100*b* formed in the sub-cavity part SC by the piston 94, the flange part 100*c* adjusted to be made thin can be formed. Thus, according to such a forming method, it is possible to suppress a reduction in strength of the metal pipe 100 that is a formed material, and to form the flange part 100*c* having a desired thickness.

The flange part 100*c* can be crushed such that the thickness of the flange part 100*c* is smaller than the thickness of the pipe part 100*a*. Therefore, welding between the flange part 100*c* and another component can be excellently performed.

In addition, when the flange part 100*b* is crushed by the piston 94, the gas supply part S supplies a gas into the pipe part 100*a*. Therefore, it is possible to suppress intrusion of a part of the crushed flange part 100*c* to the main cavity part MC, and thus the metal pipe 100 having a desired shape can be provided.

Figure 8A:
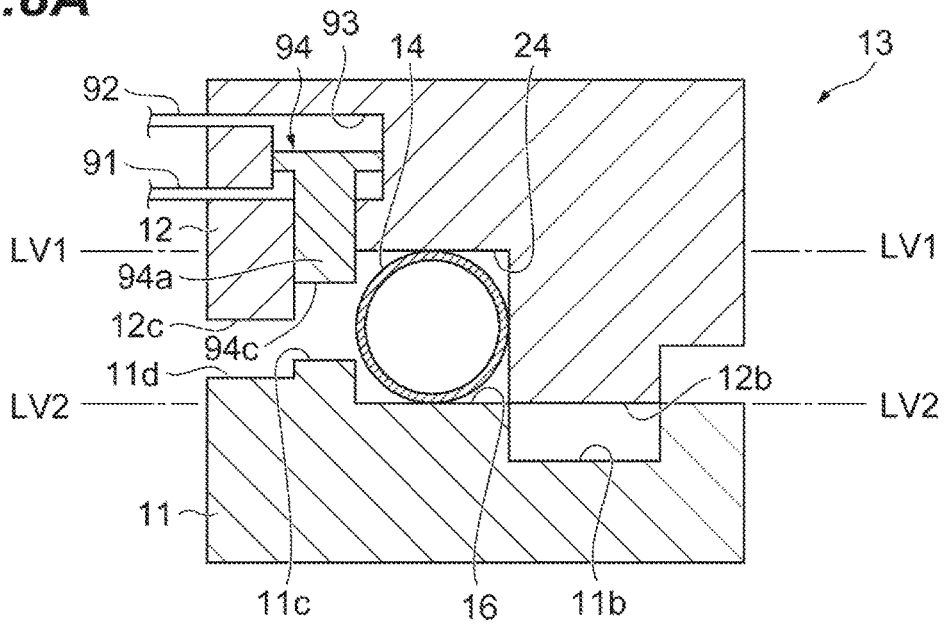
FIGS. 8A and 8B are diagrams showing another example of the operation of the blow forming die and the change of the shape of the metal pipe material.
Figure 8B:
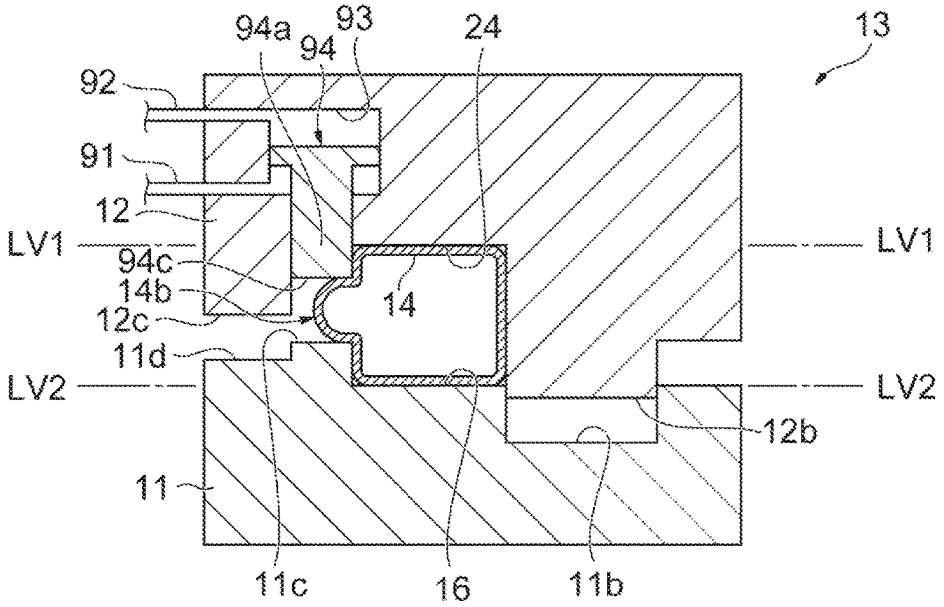

Next, another example of specific forming using the upper die 12 and the lower die 11 will be described in detail with reference to FIGS. 8A, 8B, 9A, and 9B. A method for forming a metal pipe 100 (see FIG. 9B) to be described below is different from the method for forming a metal pipe 100 described using FIGS. 6A, 6B, 7A, and 7B in that a protrusion part 14*b* (see FIG. 8B) of a metal pipe material 14 expanded by the gas supply into the metal pipe material 14 and entering between a first protrusion 11*c* of a lower die 11 and a tip end surface 94*c* of a piston 94 is crushed by the piston 94 while an upper die 12 and the lower die 11 are closed. Specifically, as shown in FIGS. 8A and 8B, before the upper die 12 and the lower die 11 are completely closed, the pressing of the protrusion part 14*b* by the piston 94 is started. The pressing by the piston 94 is started after a lower surface of a first protrusion 12*b* of the upper die 12 is positioned on the lower side beyond an upper surface of the first protrusion 11*c* of the lower die 11.

Figure 9A:
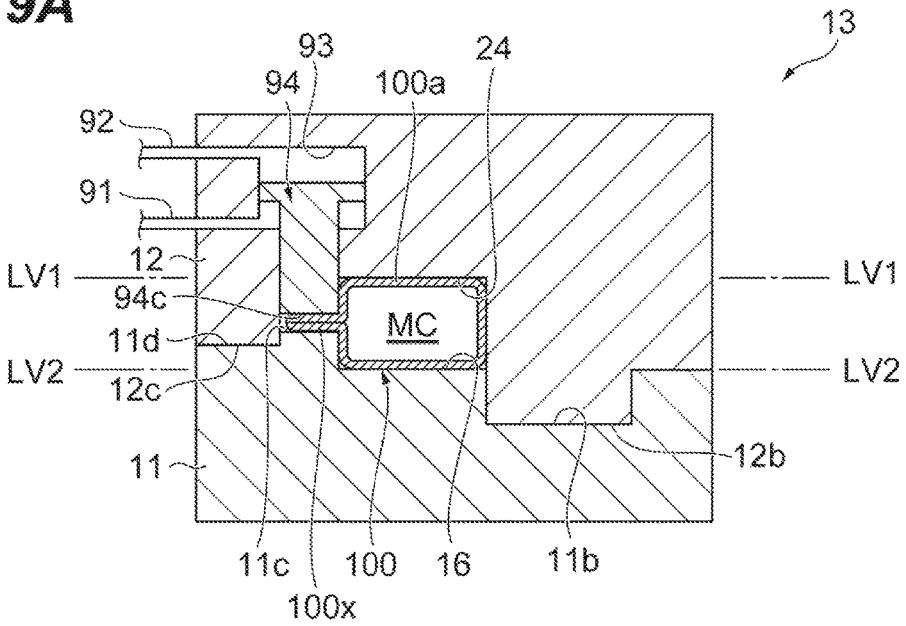
FIGS. 9A and 9B are diagrams showing another example of the operation of the blow forming die and the change of the shape of the metal pipe material, following FIGS. 8A and 8B.
Figure 9B:
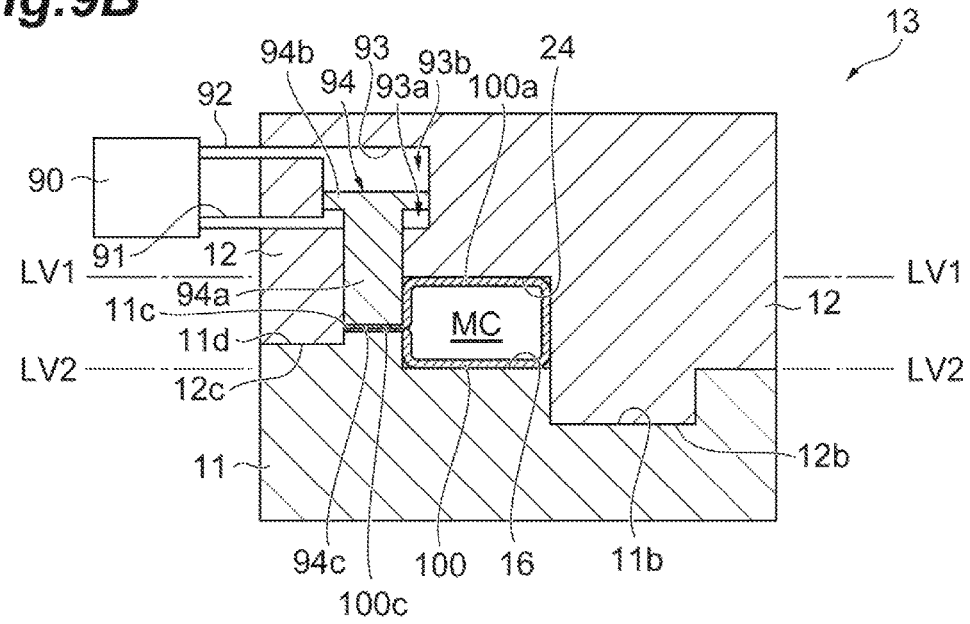

When the upper die 12 and the lower die 11 are completely closed, a pipe part 100*a* of the metal pipe 100 and a flange part 100*x* made thinner than the above-described flange part 100*b* (see FIG. 7A) can be formed as shown in FIG. 9A. By further pressing the thinned flange part 100*x* by the piston 94, a flange part 100*c* having the same thickness as in the above description can be formed (see FIG. 9B). In this manner, by starting the pressing of the protrusion part 14*b* (or the flange part 100*x*) by the piston 94 in parallel with the forming of the pipe part 100*a* of the metal pipe 100, the time period for forming a metal pipe 100 having a flange part 100*c* having a desired thickness can be reduced.

Although preferable embodiments of the invention have been described, the invention is not limited to the above-described embodiments. For example, the forming device 10 in the above-described embodiment may not essentially have the heating mechanism 50, and the metal pipe material 14 may be heated already.

The main cavity par MC and the sub-cavity part SC according to this embodiment are formed by fitting the upper die 12 and the lower die 11 together, but the invention is not limited thereto. For example, in a state in which a gap is formed between the upper die 12 and the lower die 11, a main cavity MC may be formed between the surface of the cavity 16 of the lower die 11 and the surface of the cavity 24 of the upper die 12. Or, a sub-cavity part SC may be formed between the first protrusion 11*c* of the lower die 11 and the tip end surface 94*c* of the main body part 94*a* of the piston 94.

The driving mechanism 80 according to this embodiment moves only the upper die 12. However, the driving mechanism may move the lower die 11 in addition to or in place of the upper die 12. In a case where the lower die 11 is moved, the lower die 11 is not fixed to the base 15, but is attached to the slide of the driving mechanism 80.

The cylinder 93 and the piston 94 according to this embodiment are provided in the upper die 12, but the invention is not limited thereto. These may be provided in at least one of the upper die 12 and the lower die 11.

Figure 10:
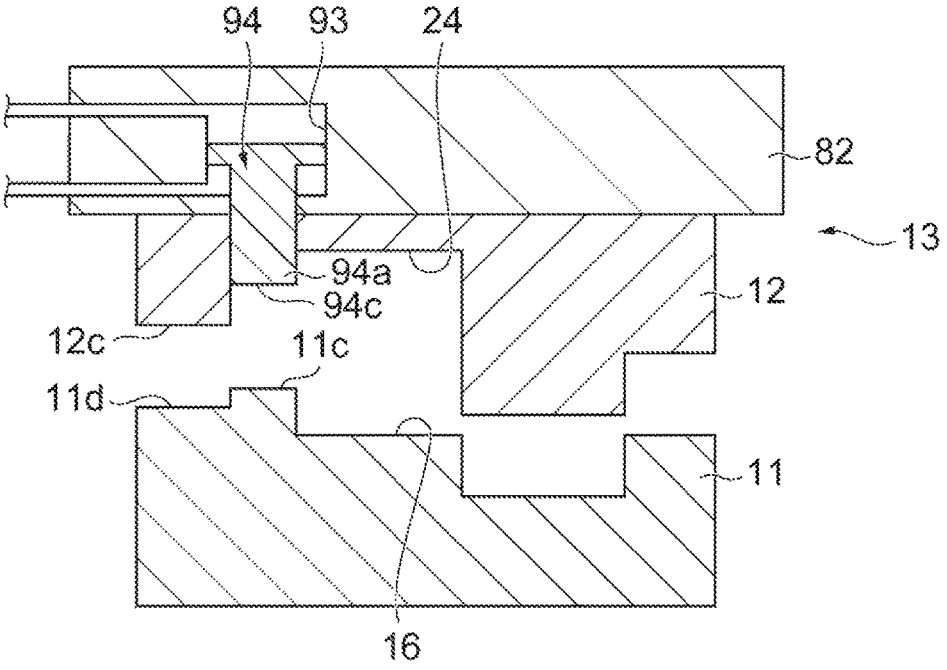
FIG. 10 is a schematic cross-sectional view showing another example of the blow forming die and a slide.

As shown in FIG. 10, the cylinder 93 may be built in the slide 82 installed on the upper surface of the upper die 12, the piston 94 may be disposed in the cylinder 93, and the tip end surface 94*c* of the main body part 94*a* of the piston 94 may penetrate the slide 82 and the upper die 12, and may be exposed and may protrude from the upper die 12 so as to be opposed to the first protrusion 11*c* of the lower die 11. The cylinder 93 and the piston 94 may be provided in the slide of the lower die 11.

The piston 94 that is a flange forming member according to this embodiment may have a configuration in which it advances or retreats by an actuator in place of the configuration in which it advances or retreats with an oil pressure obtained by the oil supply pump 90 and the cylinder 93. In addition, as the flange forming member according to this embodiment, a member other than the piston 94 may be used. In this case, the forming device 10 may not be provided with the oil supply pump 90 and the cylinder 93, and may be provided with a member necessary for using a member other than the piston 94. For example, the flange forming member may be provided by dividing the upper die into two. As a specific example thereof, a configuration in which one upper die is supported by the other upper die and advances or retreats by a moving mechanism such as a pump may be employed. In this case, one upper die may be slidably in contact with the other upper die. The lower die may also be divided into two. The upper die and the lower die may be divided into three or more.

The metal pipe 100 according to this embodiment may have flange parts at both sides. In this case, each of the flange parts at both sides is crushed by a piston provided in at least one of the upper die 12 and the lower die 11.

The forming device 10 may form a metal material other than the metal pipe material 14. For example, using the forming device 10, a heated metal material is prepared between a pair of forming dies (first die and second die). Next, at least one of the forming dies is moved in a direction in which the dies are combined together, and thus a first cavity part and a second cavity part communicating with the first cavity part are formed between the pair of forming dies. In addition, a main body part of the metal formed material is formed in the first cavity part, and a flange part of the metal formed material is formed in the second cavity part.

Thereafter, the flange part may be crushed by a flange forming member such as a piston that can be allowed to advance ore retreat in the second cavity part. Also in this case, it is possible to suppress a reduction in strength of the metal formed material and to form a flange part having a desired thickness. Examples of the metal material include a metal plate and a metal rod.

It should be understood that the invention is not limited to the above-described embodiment, but may be modified into various forms on the basis of the spirit of the invention. Additionally, the modifications are included in the scope of the invention.

What is claimed is:

1. A forming method for forming a metal formed material having a main body part, a pipe part, and a flange part, the method comprising:

preparing a heated metal material between a first die and a second die;

moving at least one of the first die and the second die in a direction in which the dies are combined together to form a first cavity part and a second cavity part communicating with the first cavity part between the first die and the second die, and forming the main body part and the flange part in the first cavity part and the second cavity part, respectively; and crushing the flange part by a flange forming member that can be allowed to advance or retreat in the second cavity part and forms the flange part, wherein the flange part is crushed such that a thickness of the flange part is smaller than a thickness of the pipe part.

* * * * *